US007332685B1

(12) United States Patent
Chou

(10) Patent No.: US 7,332,685 B1
(45) Date of Patent: Feb. 19, 2008

(54) VIBRATION SWITCH

(76) Inventor: Tien-Ming Chou, No. 41, San-Hsi 5th St., Taichung City (TW)

( * ) Notice: Subject to any disclaimer, the term of this patent is extended or adjusted under 35 U.S.C. 154(b) by 0 days.

(21) Appl. No.: 11/459,164

(22) Filed: Jul. 21, 2006

(51) Int. Cl.
*H01H 35/14* (2006.01)

(52) U.S. Cl. ..... 200/61.45 R; 200/61.48; 200/61.51; 200/61.53

(58) Field of Classification Search ..... 200/61.45 R–61.53; 73/514.01, 514.16, 514.29, 514.38, 73/514.35, 649, 652, 662, 504.12
See application file for complete search history.

(56) References Cited

U.S. PATENT DOCUMENTS 3,453,405 A * 7/1969 Gasik ..... 200/61.45 R
4,191,869 A * 3/1980 Tanaka et al. ..... 200/61.45 R
4,594,485 A * 6/1986 Brown, Jr. ..... 200/61.45 R
4,746,774 A * 5/1988 Tetrault et al. ..... 200/61.45 R
4,816,627 A * 3/1989 Janotik ..... 200/61.45 M
5,134,255 A * 7/1992 Tetrault et al. ..... 200/61.45 R
5,237,135 A * 8/1993 Wolski ..... 200/61.45 R
5,307,054 A * 4/1994 Concannon et al. ..... 340/690
5,789,716 A * 8/1998 Wang ..... 200/61.45 R
6,555,772 B1 * 4/2003 Chou ..... 200/61.45 R

* cited by examiner

*Primary Examiner*—Michael A Friedhofer
(74) *Attorney, Agent, or Firm*—Akin Gump Strauss Hauer & Feld LLP

(57) ABSTRACT

A vibration switch includes a conductive housing defining a chamber, a first electrode having a first end projecting outwardly of the housing and a second end projecting into the chamber, a moving element disposed movably in the chamber and spaced apart from the second end of the first electrode, and a resilient conductive member connected conductively to the housing and located between the moving element and the second end of the first electrode. The resilient conductive member has a contact portion that is moved by the moving element to contact electrically the second end of the first electrode.

8 Claims, 4 Drawing Sheets

VIBRATION SWITCH

BACKGROUND OF THE INVENTION

1. Field of the Invention

The invention relates to a switch, more particularly to a vibration switch.

2. Description of the Related Art

Referring to FIGS. 1 and 2, a conventional vibration switch, as disclosed by the applicant in Taiwanese Patent No. 181432, includes a casting 10, a biasing member 20, a first electrode 30, and a moving element 40.

The casing 10 defines a chamber 13, and includes first and second casing parts 11, 12. The first casing part 11 is made of a conductive material, and has a first inner wall face 111, a first outer wall face 112, and a second electrode 113 projecting outwardly from the first outer wall face 112. The second casing part 12 is made of an insulating material, and has a second inner wall face 121 spaced apart from the first inner wall face 111, and a second outer wall face 122. A metal piece 123 is provided on the second inner wall face 121, and is connected electrically to the first casing part 11.

The biasing member 20 is a compression spring disposed in the chamber 13 and in contact with the metal piece 123.

The first electrode 30 is a conductive rod having one end inserted into the chamber 13 through the second outer and inner wall faces 122, 121. The metal piece 123 has a central through hole for extension of the first electrode 30 therethrough so that the metal piece 123 and the first electrode 30 are not connected electrically.

The moving element 40 is configured as a metal ball that is disposed movably in the chamber 13. When no external force is received by the conventional vibration switch, the moving element 40 abuts against the first inner wall face 111 through a biasing action of the biasing member 20 so that the moving element 40 is spaced apart from the first electrode 30.

When the conventional vibration switch is vibrated, the moving element 40 is displaced to thereby compress the biasing member 20 against the metal piece 123, so that the moving element 40 can connect electrically the first electrode 30 to the first casing part 11 through the biasing member 20 and the metal piece 123. When the moving element 40 is separated from the first electrode 30 by a restoring force of the biasing member 20, electrical connection between the first electrode 30 and the first casing part 11 is cut.

However, since the moving element 40 is not connected fixedly to the biasing member 20, and since the biasing member 20 is not connected fixedly to the metal piece 123, electrical connection between the first electrode 30 and the first casing part 11 is achieved through electrical contact points 101 between the first electrode 30 and the moving element 40, between the moving element 40 and the biasing member 20, and between the biasing member 20 and the first casing part 11. Since electrical connection of the conventional vibration switch is achieved through these three contact points 101, not only are unstable signals generated during use, but also electrical connection must occur at each of these three contact points 101 in order to achieve electrical connection between the first electrode 70 and the first casing part 11, thereby adversely affecting sensitivity of the conventional vibration switch.

SUMMARY OF THE INVENTION

Therefore, the object of the present invention is to provide a vibration switch that has high sensitivity and that can be operated accurately.

According to this invention, a vibration switch comprises a conductive housing defining a chamber, a first electrode having a first end projecting outwardly of the housing and a second end projecting into the chamber, a moving element disposed movably in the chamber and spaced apart from the second end of the first electrode, and a resilient conductive member connected conductively to the housing and located between the moving element and the second end of the first electrode. The resilient conductive member has a contact portion. The contact portion of the resilient conductive member is moved by the moving element to contact electrically the second end of the first electrode.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 2:
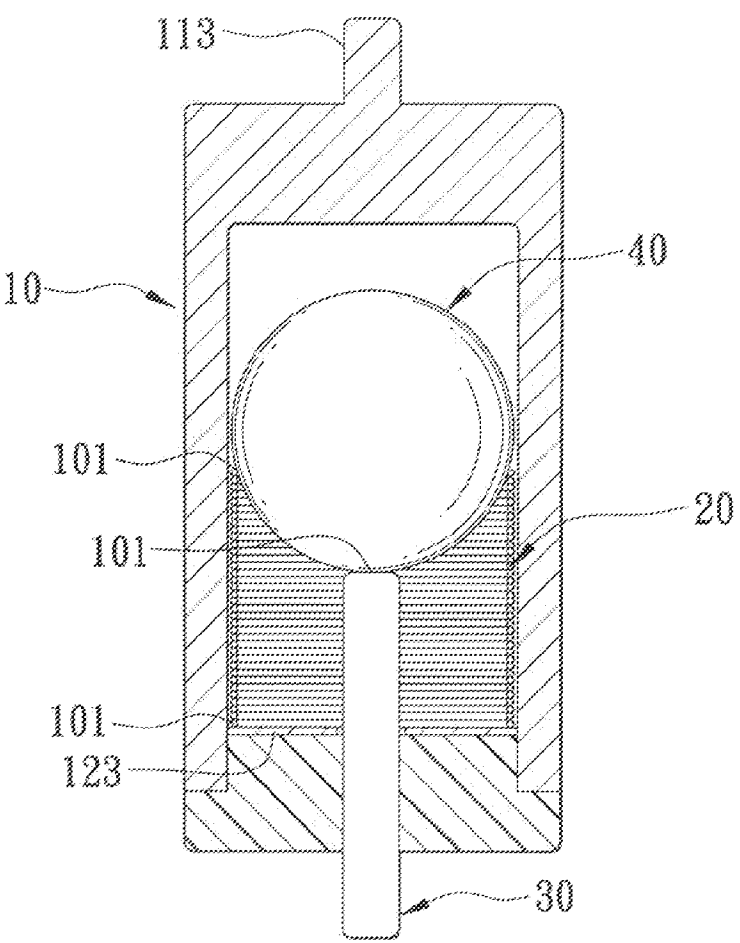
FIG. 2 PRIOR ART
FIG. 2 is a view similar to FIG. 1, but with the conventional vibration switch in a state of use.
Figure 1:
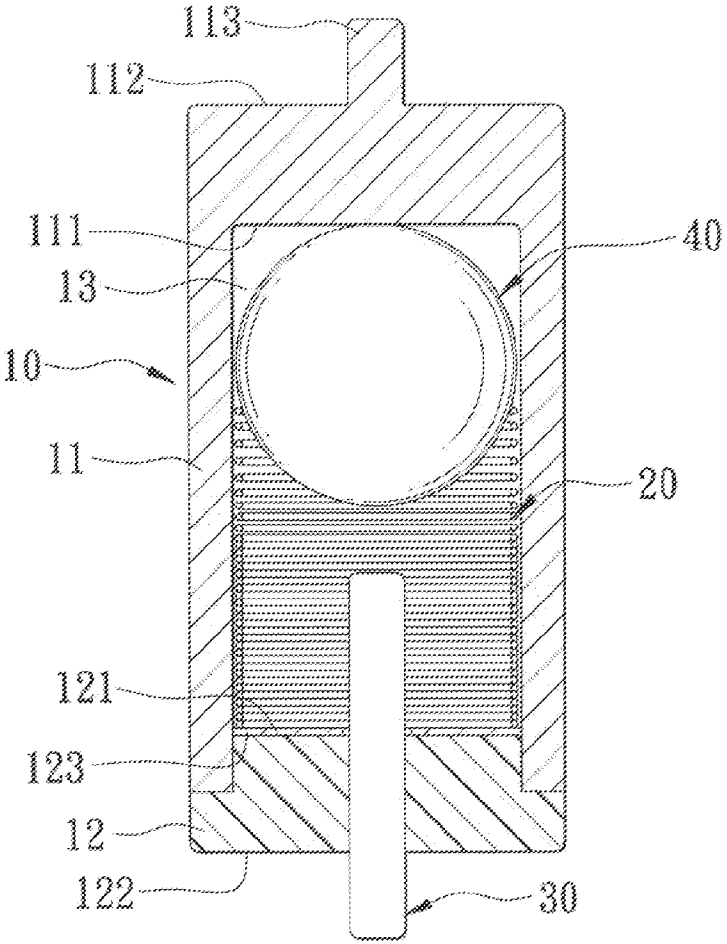
FIG. 1 PRIOR ART
FIG. 1 is a sectional view of a conventional vibration switch disclosed in Taiwanese Patent No. 181432.
Figure 3:
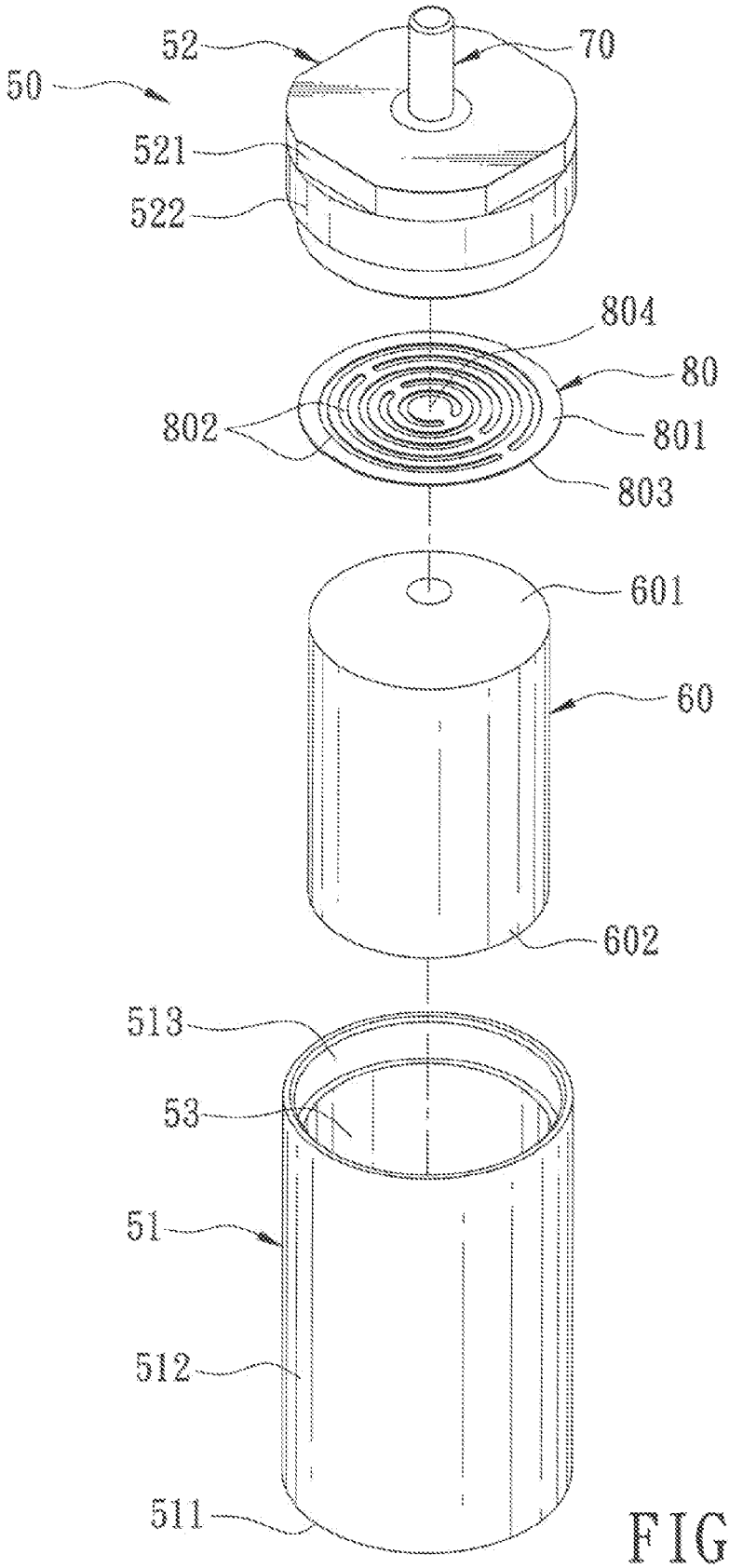
FIG. 3 is an exploded perspective view of the preferred embodiment of a vibration switch according to the present invention.

Referring to FIGS. 3 to 6, the preferred embodiment of a vibration switch according to the present invention is shown to comprise a conductive housing 50, a moving element 60, a first electrode 70, and a resilient conductive member 80.

The conductive housing 50 defines a chamber 53, and includes a first casing part 51, and a second casing part 52. The first casing part 51 is made of a conductive material, and includes a bottom wall 511, a surrounding wall 512 extending upwardly from a peripheral end of the bottom wall 511, a shoulder 513 formed in an inner surface of the surrounding wall 512 opposite to the bottom wall 511, and a second electrode 516 projecting from an outer surface of the bottom wall 511.

The second casing part 52 is fitted to the surrounding wall 512 of the first casing part 51, and includes a non-conductive sealing part 521 and a conductive cover part 522. The conductive cover part 522 covers a top end of the surrounding wall 512, is partially inserted into the surrounding wall 512, and has a through hole 5221, and an annular protrusion 5222 projecting downwardly from a bottom end of the conductive cover part 522. The non-conductive sealing part 521 is formed at least partially in the through hole 5221. In an alternative embodiment, the second casing part 52 may be entirely made of an insulating material.

In this embodiment the conductive cover part 522 and the first electrode 70 are first placed in a mold (not shown), after which the non-conductive sealing part 521 is formed through an injection molding process. As such, the conductive cover part 522, the non-conductive sealing part 521, and the first electrode 70 are connected tightly to each other. The non-conductive sealing part 521 is formed surrounding part of the first electrode 70 through the injection molding process. After the moving element 60 and the resilient conductive member 80 have been placed in the first casing part, the second casing part 52 is coupled to a top end of the surrounding wall 512 of the first casing part 51.

In order to realize a tight connection among the conductive cover part 522, the first electrode 70, and the non-conductive sealing part 521, the conductive cover part 522 may be provided with a knurled inner peripheral surface 525, and the first electrode 70 may be provided with a knurled outer peripheral surface 72.

The first electrode 70, in this embodiment, is a conductive rod, and has a first end 73 projecting outwardly of the housing 50 through the sealing part 521, and a second end 71 projecting into the chamber 53. The first electrode 70 is opposite to the second electrode 516.

The moving element 60 is disposed movably in the chamber 53, and is spaced apart from the second end 71 of the first electrode 70 when no external force is received by the vibration switch. In this embodiment, the moving element 60 is configured as a cylindrical element that has tapered top and bottom ends 601, 602 and that is made of an insulating material. The moving element 60 is guided by the surrounding wall 512 to move within the chamber 53, and has a mass sufficient to produce a pushing force during vibration. The moving element 60 need not be limited to an insulating material, and it may be made of a conductive material, such as metal.

The resilient conductive member 80 is disposed within the chamber 53 between the first electrode 70 and the moving element 60. In this embodiment, the resilient conductive member 80 is made by punching a thin metal plate so as to form a thin spring plate 801 having a plurality of substantially C-shaped slits 802 that are substantially concentric to each other, and a peripheral edge 803 seated on the shoulder 513. A contact portion 804 is provided at a central part of the thin spring plate 801.

When the second casing part 52 is fitted to the first casing part 51, the annular protrusion 5222 of the conductive cover part 522 projects into the top end of the surrounding wall 512, and presses the peripheral edge 803 of the thin spring plate 801 against the shoulder 513, so that the resilient conductive member 80 is connected electrically and constantly to the first casing part 51. Normally, the resilient conductive member 80 is spaced apart from the second end 71 of the first electrode 70.

Figure 5:
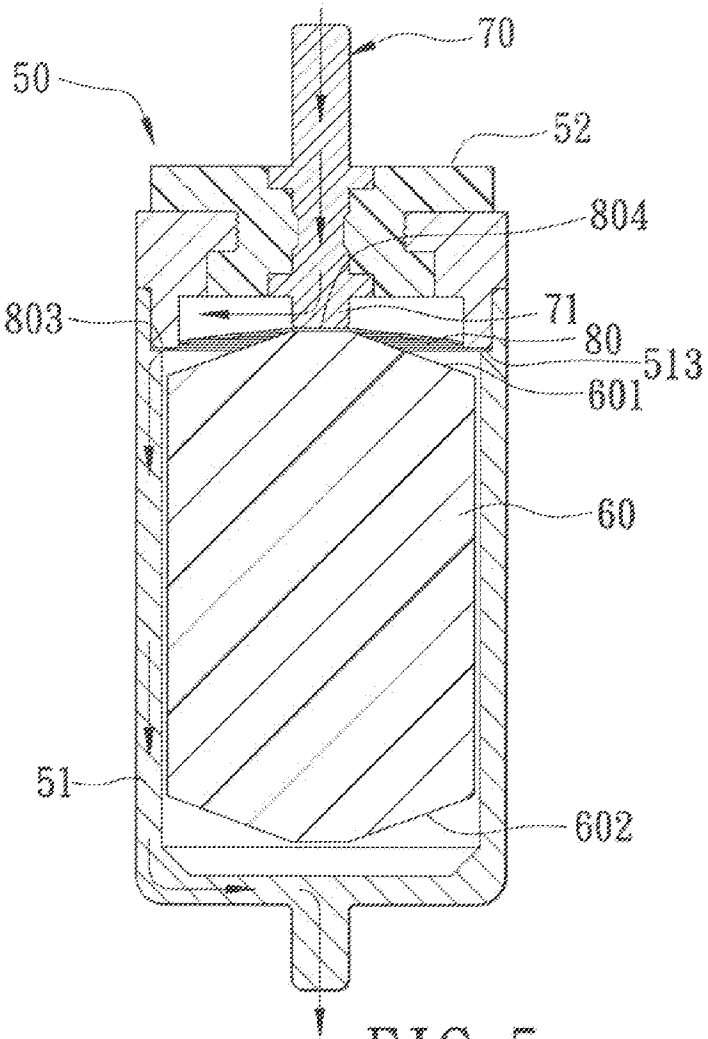
FIG. 5 is a schematic view of the preferred embodiment in a state of use.
Figure 4:
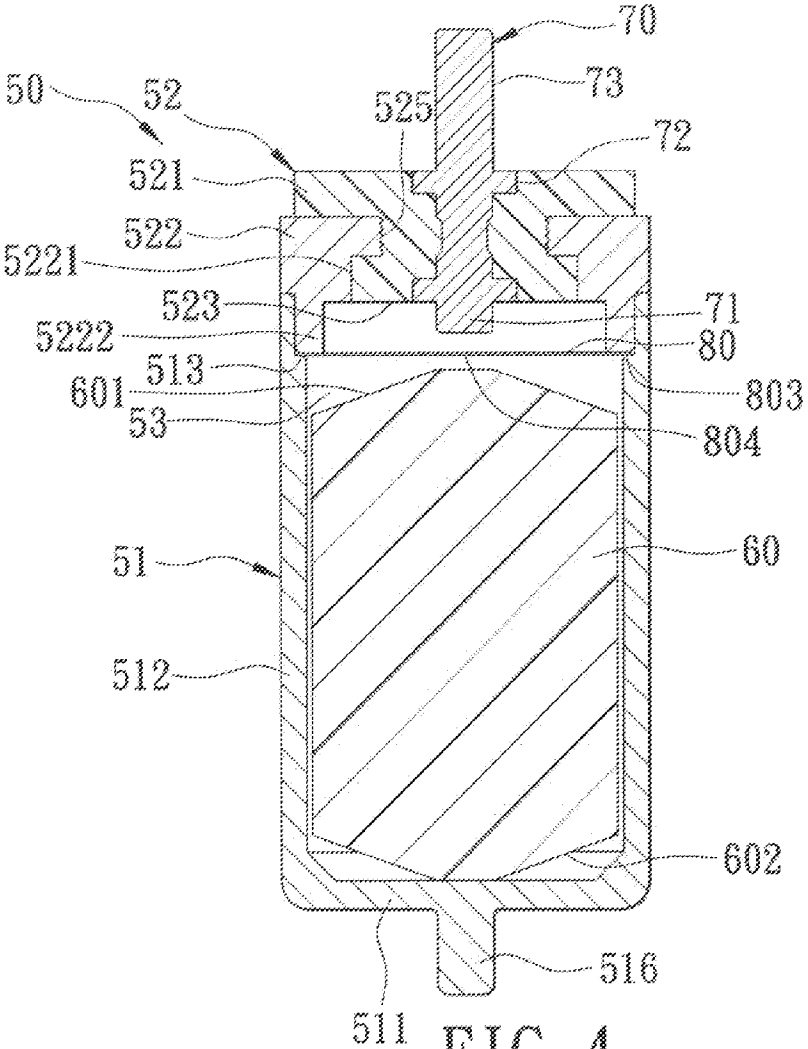
FIG. 4 is a sectional view of the preferred embodiment in an assembled state.

With reference to FIG. 5, when the vibration switch is vibrated, the tapered top end 601 of the moving element 60 pushes the contact portion 804 of the resilient conductive member 80 to contact electrically the second end 71 of the first electrode 70. As such, the first electrode 70 can be connected electrically to the second electrode 516 through the resilient conductive member 80 and the first casing part 51. When the resilient conductive member 80 moves away from the first electrode 70 as a result of the moving element 60 no longer pushing against the resilient conductive member 80, electrical connection between the first and second electrodes 70, 516 is cut.

Figure 6:
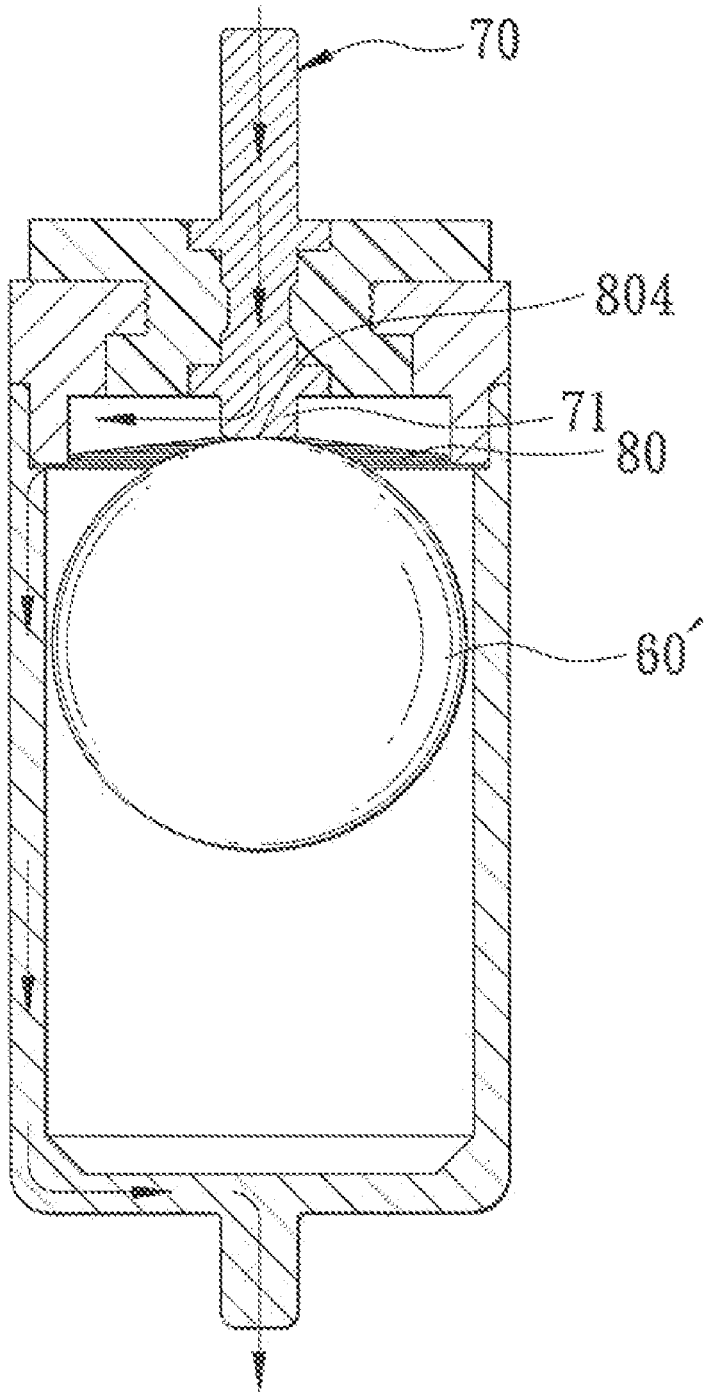
FIG. 6 illustrates an alternative form of a moving element of the preferred embodiment.

With reference to FIG. 6, in an alternative embodiment, the moving element 60' may be configured as a ball such as that used in the conventional vibration switch, or as an element having any other suitable shape. The moving element 60' can similarly push the contact portion 804 of the resilient conductive member 80 to contact electrically the second end 71 of the first electrode 70 when the vibration switch of the present invention is vibrated.

From the aforementioned description, it is apparent that the vibration switch of the present invention can operate reliably and simply to achieve electrical connection between the first and second electrodes 70, 516. This is made possible as a result of the resilient conductive member 80 being in constant electrical contact with the first casing part 51 and by virtue of the fact that electrical contact is made only at one contact point, i.e., between the second end 71 of the first electrode 70 and the contact portion 804 of the resilient conductive member 80. Therefore, the vibration switch of the present invention has high sensitivity, and can generate stable and accurate switching signals.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A vibration switch comprising:

a conductive housing defining a chamber;

a first electrode having a first end projecting outwardly of said housing and a second end projecting into said chamber;

a moving element disposed movably in said chamber and spaced apart from and disposed below said second end of said first electrode; and a resilient conductive member including a thin spring plate that is located between said moving element and said second end of said first electrode and that has a peripheral edge connected conductively to said housing, said thin spring plate further having a central contact portion disposed above said moving element, said central contact portion of said thin spring plate being movably upwardly by said moving element to contact electrically said second end of said first electrode.

2. The vibration of claim 1, wherein said housing includes a first casing part and a second casing part, said first casing part including a bottom wall opposite to said first electrode, a surrounding wall extending upwardly from a peripheral end of said bottom wall, and a shoulder formed in an inner surface of said surrounding wall opposite to said bottom wall, said peripheral edge being seated on said shoulder.

3. The vibration switch of claim 2, wherein said second casing part includes a conductive cover part and a non-conductive sealing part, said conductive cover part covering a top end of said surrounding wall opposite to said bottom wall, being partially inserted into said surrounding wall, and having a through hole, said non-conductive sealing part surrounding said first electrode and being formed in said through hole.

4. The vibration switch of claim 1, wherein said thin spring plate has a plurality of substantially C-shaped slits that are substantially concentric to each other.

5. The vibration switch of claim 2, wherein said first casing part further includes a second electrode projecting outwardly from said bottom wall.

6. The vibration switch of claim 2, wherein said second casing part has an annular protrusion projecting into a top end of said surrounding wall opposite to said bottom wall and pressing said peripheral edge of said thin spring plate against said shoulder.

7. The vibration switch of claim 2, wherein said moving element is configured as a cylindrical element that is guided by said surrounding wall to move within said chamber and that has a tapered top end to push said central contact portion of said thin spring plate to contact electrically said second end of said first electrode.

8. The vibration switch of claim 1, wherein said moving element is configured as a ball.

* * * * *